US007721379B2

(12) United States Patent
Takahashi

(10) Patent No.: US 7,721,379 B2
(45) Date of Patent: May 25, 2010

(54) SMALL-DIAMETER RESIN TWISTED BRUSH

(76) Inventor: Atsushi Takahashi, 20-15-1 Kizaki, Tsuruga (JP) 9140814

( * ) Notice: Subject to any disclaimer, the term of this patent is extended or adjusted under 35 U.S.C. 154(b) by 121 days.

(21) Appl. No.: 10/579,600

(22) PCT Filed: Nov. 15, 2004

(86) PCT No.: PCT/JP2004/016930

§ 371 (c)(1),
(2), (4) Date: Apr. 2, 2007

(87) PCT Pub. No.: WO2005/048771

PCT Pub. Date: Jun. 2, 2005

(65) Prior Publication Data

US 2008/0034524 A1 Feb. 14, 2008

(30) Foreign Application Priority Data

Nov. 18, 2003 (JP) ..... 2003-388512

(51) Int. Cl.
*A46B 3/18* (2006.01)
*A46B 9/04* (2006.01)

(52) U.S. Cl. ..... 15/167.1; 15/206

(58) Field of Classification Search ..... 15/164, 15/206, 167.1
See application file for complete search history.

(56) References Cited

U.S. PATENT DOCUMENTS 3,124,823 A * 3/1964 Charvat ..... 15/206
4,395,943 A * 8/1983 Brandli ..... 15/167.1
4,974,279 A * 12/1990 Mathison ..... 15/160
5,253,386 A * 10/1993 LaLonde ..... 15/206
5,490,529 A * 2/1996 Fitjer ..... 132/218
5,638,568 A * 6/1997 Dumler et al. ..... 15/167.1
5,699,578 A * 12/1997 Dumler et al. ..... 15/167.1
6,016,815 A * 1/2000 Christoforou et al. ..... 132/218
6,434,778 B1 * 8/2002 Edwards et al. ..... 15/159.1
2004/0175675 A1 * 9/2004 Brezler et al. ..... 433/216
2005/0133056 A1 * 6/2005 Montoli ..... 132/218

FOREIGN PATENT DOCUMENTS

JP 5-317123 12/1993
JP 5-317338 12/1993

(Continued)

*Primary Examiner*—Randall Chin
(74) *Attorney, Agent, or Firm*—Quintero Law Office

(57) ABSTRACT

A resin twisting brush, wherein the material of the shaft part of an interdental brush (the twisting brush) is formed of a resin material having shape restorability and elasticity to provide the brush with proper elasticity, shape restorability, and flexibility and prevent the shaft part from being deformed nor broken so that the shaft part can be deformed and easily inserted when the interdental brush (the twisting brush) is inserted into a narrow portion such as a hourglass-shaped interdental space. Thus, an interdental cleaning assisting tool well matching the three-dimensional shape of an interdental part, capable of maintaining straightness without causing permanent deformation when the shaft part is bent despite the fact that the tool can be inserted into the interdental part restricted in the inserting direction, providing less pain and less uncomfortable feeling and providing comfortable feeling when the tool comes into contact with a tooth and a gum during the cleaning operation, and not damaged also by repeated bending can be provided.

6 Claims, 4 Drawing Sheets

FOREIGN PATENT DOCUMENTS

| | | |
|---|---|---|
| JP | 9-47323 | 2/1997 |
| JP | 10-94429 | 4/1998 |
| JP | 10-117846 | 5/1998 |
| JP | 2000-120 | 1/2000 |
| JP | 2000-253931 | 9/2000 |
| JP | 2002-177304 | 6/2002 |
| WO | WO 03/011073 A1 | 2/2003 |

* cited by examiner

[Fig. 1]
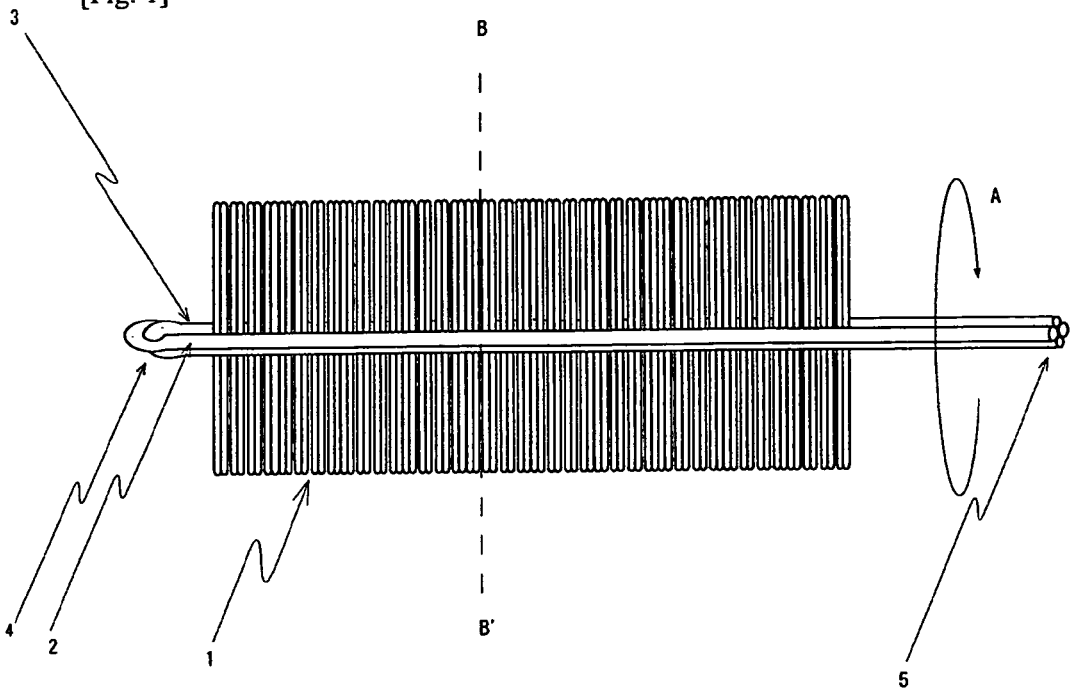
[Fig. 2]
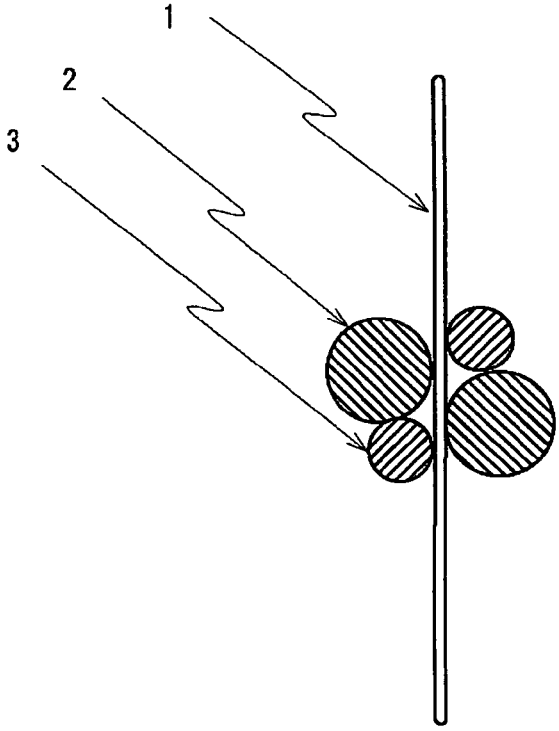

[Fig. 3]
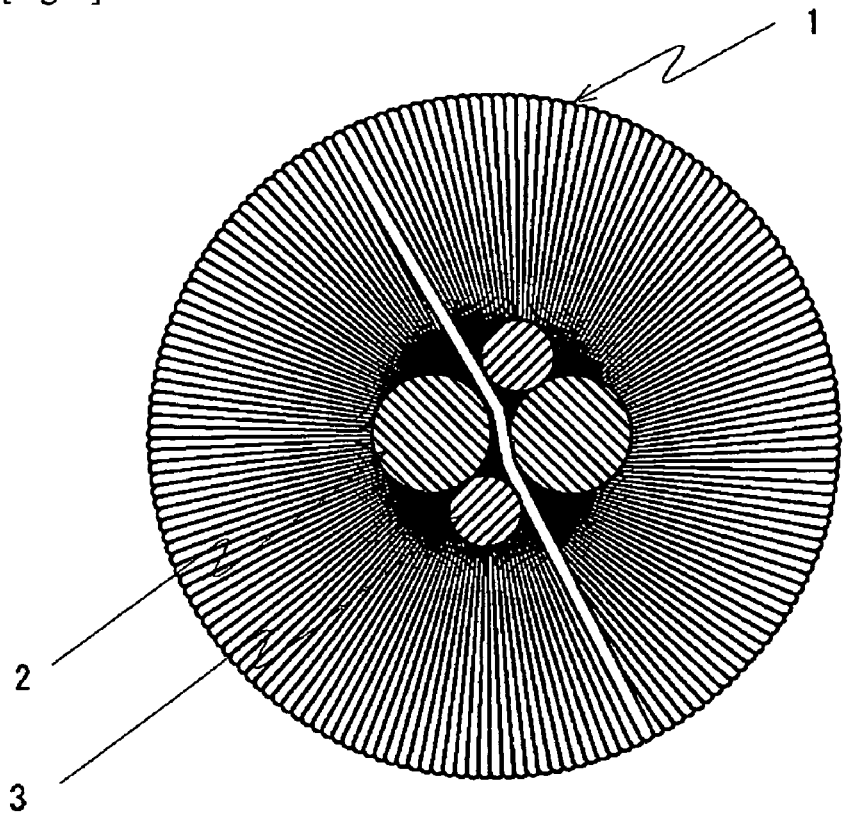
[Fig. 4]
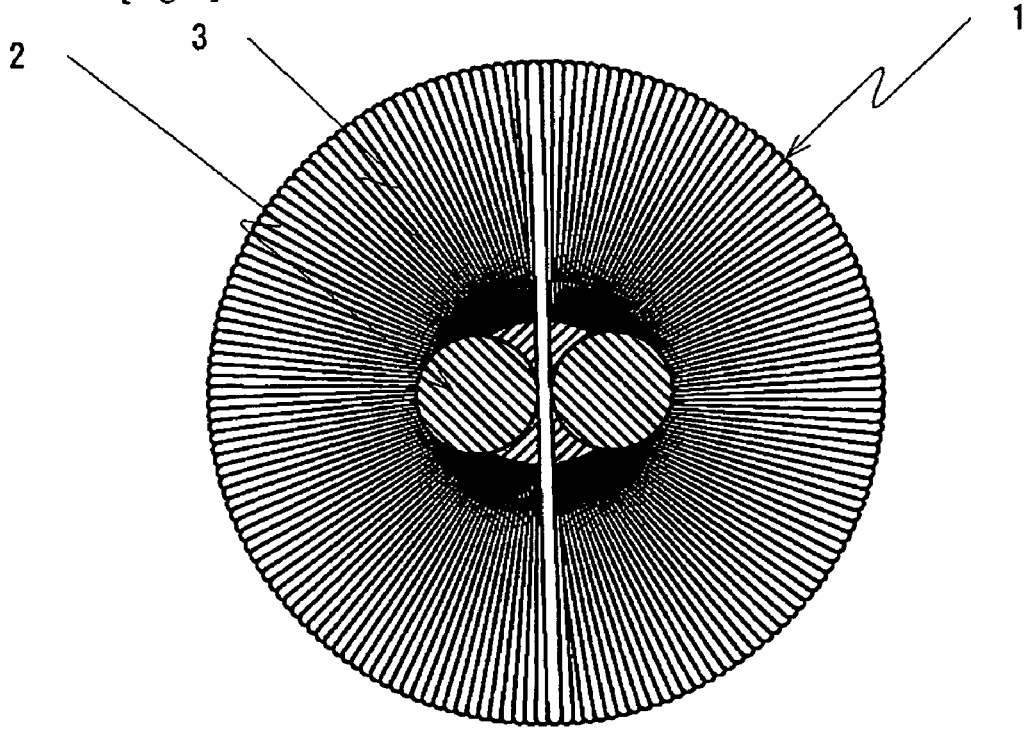

[Fig. 5]
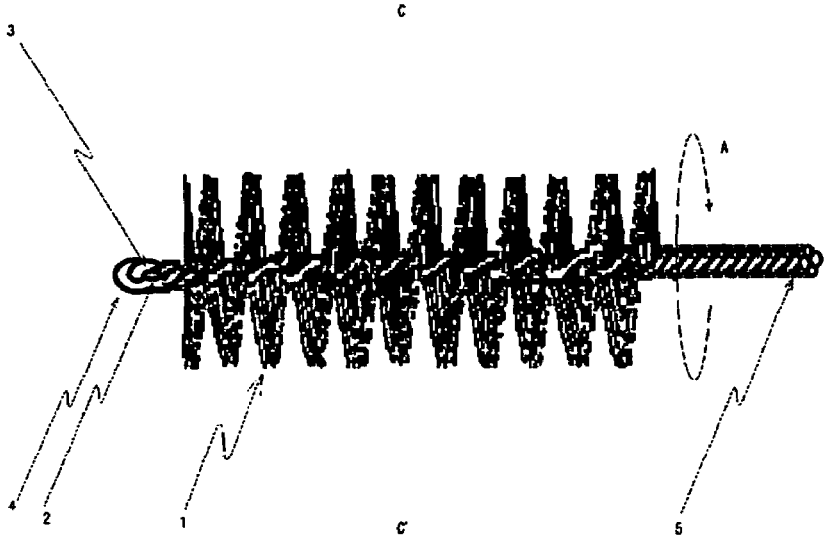
[Fig. 6]
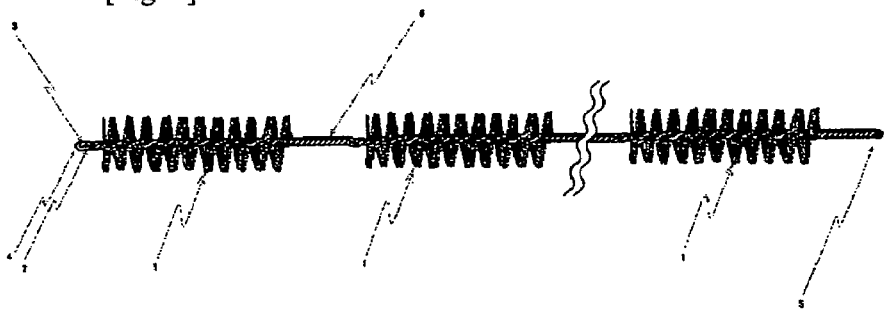
[Fig. 7]
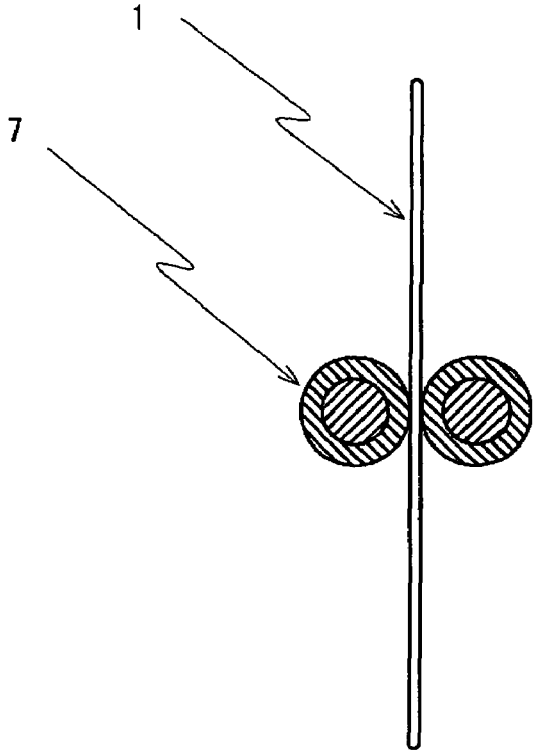

[Fig. 8]
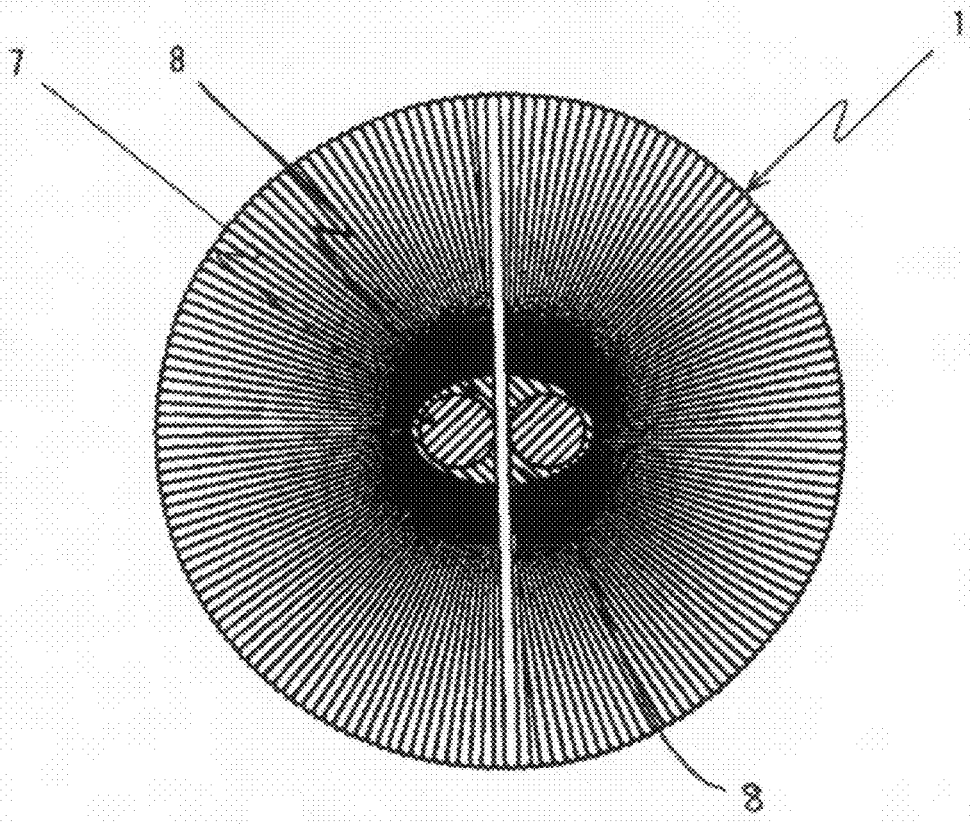

SMALL-DIAMETER RESIN TWISTED BRUSH

TECHNICAL FIELD

Plaque which adheres to tooth surfaces and periodontal tissues provides a breeding ground for bacteria which cause tooth decay and pyorrhea, the causes for tooth loss. The present invention is directed to an oral cleaning device optimum for controlling plaque between adjacent teeth, a particular cause of periodontal disease, a mascara brush used for making up eyelashes (cilia), and the like, as well as a small-size, twisted brush optimum for cleaning or polishing a curved small-diameter pipe of complicated shape or the like.

BACKGROUND TECHNOLOGY

In general, the two major diseases causing the loss of teeth are caries and pyorrhea; in particular, cases of gingival recession due to periodontal disease are not susceptible to interdental plaque control by a common toothbrush, resulting in the need for extensive use of an oral cleaning device such as an interdental brush. A typical cleaning device, an interdental brush, is a twisted brush with nylon bristles arranged concentrically around a twisted metal filament, but these types have been plagued with numerous problems which limit their widespread adoption for oral care: when the tip of the brush hits the gum during an interdental insertion, it often injures the gum; it causes discomfort when the metal tip touches the tooth; and repeated use during cleaning causes high breakage of the twisted metal filament due to metal fatigue. When cleaning is performed between three-dimensionally concave, complicated teeth, such as in a root branching site, the metal which constitutes the interdental brush stem not only resists insertion, causing problems, but also suffers from the risk of leaving uncleaned sections, if the cleaning brush is pre-curved to accommodate its insertion. The use of a shape memory nickel titanium alloy is conceivable for avoiding this problem, but, if a shaping method similar to that used for a twisted brush is involved, the de-twisting of the metal filament will end up causing nylon bristles to fall out. Therefore, resin materials have been studied as materials to constitute the stem; but, since the interdental brush requires the brush section to penetrate through a 0.8 mm diameter space for cleaning interdentally, it has been difficult to injection mold so as to insert nylon bristles into a resin material of this diameter. Other methods include electrostatically implanting nylon piles in the radial direction into a shape memory metal filament rod or a resin filament rod, but it is necessary for the diameter of the stem for penetration of the brush section into a 0.8 mm diameter space to be about 0.4 mm or less. It has been difficult to uniformly implant nylon bristles about 2 mm to about 4 mm in total length into a filament rod of this diameter and, in addition, to find an adhesive with no biological hazard so as to prevent the loss of bristles. Applications for such small twisted brushes also include cosmetic tools such as cosmetic mascara brushes and the like, where basically the stem material has been a metal material.

In addition, this type of twisted shape brush is also used for polishing or cleaning various pipe-shaped items, but use in a complex curved section gave no choice but to connect a supple material to the handle, if the handle is made of metal, because the depth of penetration was limited.

Patent Reference 1: Japanese Patent Application 10-181595 and Japanese Patent Application 4-152991

DISCLOSURE OF THE INVENTION

Problems to be Solved by the Invention

As described above, interdental plaque control is very useful. It is an object of the present invention to replace the conventional metal stem material with a material that gives an idea of a soft sensation for providing an interdental auxiliary cleaning device, which, when used to insert the interdental cleaning device between drum, saddle-shaped teeth for interdental oral cleaning, will not injure the gum with the tip of the cleaner of the core portion, which permits easy insertion without causing pain or discomfort simultaneously, which permits insertion with no resistance between teeth having restriction in the insertion direction, like a maze or having a complicated root shape, which maintains straightenability without any permanent deformation when the stem section is bent, which allows close fitting to the three-dimensional interdental configuration so as to leave no uncleaned sections in the root interstices, which causes little discomfort when coming into contact with the tooth or the gum during the cleaning operation, and which undergoes minimal breakdown upon repeated bending; and also for use in a cosmetic mascara brush without fear when used near the eyeball.

Other applications include replacing the stems themselves with a resilient, shape recoverable, and supple material for use in polishing and cleaning various pipe shaped goods with a complicated curved structure so as to permit a longer penetration depth.

Means to Solve the Problems

In general, small-size twisted brushes used for interdental brushes and the like require twisting a stainless filament or like metal which constitutes the stem portion, thereby clamping nylon bristles in place. The present invention, in order to replace the conventional interdental brush stem with a resin material having both optimum suppleness and straightenability (shape recovery), involves, as in the case of a conventional metal interdental brush manufacturing step, the clamping of nylon bristles in a perpendicular direction between two pieces of resin material and twisting one end, while holding the other, thereby clamping and generating a twisted brush using a resin material. However, it is difficult for the stem resin material to maintain its twisted configuration, and also to provide suppleness and shape recoverability, such as straightenability and the like, which are the desired properties of the initial objective. Therefore, the present invention is directed to a small-diameter resin twisted brush constructed by arraying two pieces of resin filament material and thermally fusible resin filaments in parallel thereto, heat-treating at any stage before, during or after a step of clamping radially-projecting filaments in the stem filaments rods and twisting so as to form a twisted brush shape, thereby melting only the thermally fusible resin to mutually fuse the two pieces of resin material themselves that form a stem member with the radially-projecting filaments such as nylon bristles, and fuse-fixating the de-twisting stress of the stem member resin materials, so that the brush can maintain the twisted brush configuration with the radially-projecting filaments clamped, preventing the bristles from falling out.

The above means provide the functions given below.

Advantageous Effects of the Invention

The small-diameter resin twisted brush reduces any fear when used near the eyeball as in a mascara brush because the stem is not made of metal as in the case of conventional twisted brushes; there is neither any discomfort due to a galvanic electric current between the saliva and the metal when used orally nor worry of metal-induced allergy when used for a long period of time.

Further, as the brush structure is the same as that of the conventional twisted brush, the bristle performance is not lost, and it is possible to take advantage of the features of each resin material, thereby resulting in the excellent effects of imparting suppleness not present in the conventional metal twisted brush, maintaining straightenability due to the shape recoverability immediately after use under bent and deformed conditions, and providing a soft use comfort.

Similarly, this twisted brush is made of a resilient, shape recoverable, supple, resin material of similar properties for the stem itself, so that the entire brush from the tip to the extended holder section is resilient, shape recoverable (straightenable), and supple, enabling one to respond to a cleaning or polishing operation of a variety of pipe shaped goods regardless of complicatedly curved shapes at a deeper penetration depth.

The nylon bristles referred to here may not be limited to resin materials, but may be a metal material; the resin material may occlude or be bound with polishing particles, permitting one to make up a twisted brush with a high polishing capability according to the conditions of the polishing and cleaning objectives, while the stem maintains shape recovery or suppleness.

BRIEF DESCRIPTION OF THE DRAWINGS

FIG. 1 shows the way the radially-projecting resin filaments uniformly arranged in parallel are clamped in a perpendicular crossing direction with the resin filament rods and thermally fusible resin filament rods.

FIG. 2 shows the B-B' cut in the stem direction of FIG. 1.

FIG. 3 is a C-C' cross-section of FIG. 5 showing the way the radially-projecting resin filaments uniformly arranged in parallel are clamped in a perpendicular crossing direction with the resin filament rods and thermally fusible resin filament rods.

FIG. 4 is a C-C' cross-section of FIG. 5 showing the way a twisted brush with radially-projecting resin filaments is formed by holding the stem tip while twisting the stem rear end.

FIG. 5 is a cross-section in the stem direction showing the way the thermally fusible resin has melted and bonded by super heating while a twisted brush with radially-projecting resin filaments is formed and held by holding the stem tip while twisting the stem rear end.

FIG. 6 shows the way twisted brushes are formed continuously at fixed intervals so as to shorten the time for cooling and holding per piece for enhanced production efficiency.

FIG. 7 shows the way the radially-projecting resin filaments uniformly arranged in parallel are clamped In a perpendicular crossing direction the thermally fusible resin-coated resin filament rods.

FIG. 8 is a cross-section in the stem direction showing the way the thermally fusible resin has melted and bonded by super heating while a twisted brush with radially-projecting resin filaments is formed and held by holding the stem tip of the thermally fusible resin-coated resin filament rods while twisting the stem rear end.

DESCRIPTION OF REFERENCE SYMBOLS

1. Radially-projecting resin filaments
2. Resin filament rod
3. Thermally fusible resin filament rod
4. Stem tip
5. Stem rear end
6. Portions lacking stem bristles
7. Thermally fusible resin-coated resin filament rod
8. Thermally fusible filament resin melt-deformed bonded portion

THE BEST EMBODIMENT FOR CARRYING OUT THE INVENTION

Hereafter, the embodiments of the present invention are explained with reference to the attached drawings.

Embodiment 1

FIGS. 1-8 are examples of manufacturing steps and embodiments for working the invention; in these figures, like symbols represent like objects where the basic construction is similar to that of the conventional one shown in the drawings.

As shown in FIG. 1, multiple radially-projecting resin filaments 1 are arrayed, parallel to one another, and clamped by, stem resin filament rods 2 with thermally fusible resin filament rods 3 parallel thereto. FIG. 2 shows the way the assembly is viewed from the stem direction. In this condition, twisting by holding the stem tip portion 4 and tip rear end 5 causes the radially-projecting resin filaments 1 to become helically oriented around the stem as the center axis of a concentric circle, as shown in FIG. 3, giving rise to a twisted brush shape. Heat treating the entire assembly, while the above state is maintained, melts only the thermally fusible resin filament rods 3, as in FIG. 4, thereby fusing each of the radially-projecting resin filaments 1, which constitute the bristles, with the two or more resin filament rods 2, generating a small-diameter resin twisted brush as shown in FIG. 5 which maintains a twisted brush shape, which prevents the bristles from falling out, prevents the resin filament rods that constitute the twisted stem portion from detwisting, and which has helical bristles. In this case, the timing for the heat treatment may be during or before the twisting step. In order to shorten the time required to retain each twisted brush of the stem tip 4 and stem rear end 5 until the heat treated thermally fusible resin filament rods 3 have cooled and solidified, any number of twisted brush units may have the radially-projecting resin filaments positioned at fixed intervals flanked by sections lacking stem bristles, (FIG. 6), and then be twisted and heat treated, thereby permitting production efficiency to be enhanced.

Since the cut surface is expected to have sharp edges, it is preferred to subject the stem tip section 4 to ultrasonic, radio frequency or machining treatment to remove these edges for gaining a smooth shape.

As shown in FIG. 7, construction of the radially-projecting resin filaments 1 with thermally fusible resin-coated resin filament rods 7, and heat treating during, before, or after the twisting step, fuses, as shown in FIG. 8, only the thermally fusible resin portion of the thermally fusible resin-coated resin filament rods 7, thereby fusing together the radially-projecting resin filament rods 1 with the resin filament rods 2 that constitute the core portion of the thermally fusible resin-coated resin filament rods 7, thereby maintaining a twisted brush shape which prevents the bristles from falling out, prevents the resin filament rods which constitute the twisted stem portion from detwisting, and which forms the helical bristles.

The resultant small-diameter resin twisted brush, may be used by connecting it to the motion shaft of an electrical interdental cleaning device that generates a sliding motion, a rotating motion, or a rotary-sliding motion as in Japanese Patent Applications 2000-380686 and 2001-230207 or in a manual interdental cleaning device. Incidentally, the small-diameter resin twisted brush of this invention is not limited to the above manufacturing steps and embodiments so that a variety of modifications may obviously be made within the scope not deviating from the gist of the present invention, as for the resin rods used for the stem, the number of the thermally fusible resin filament rods, the materials and array conditions of the radially-projecting resin filaments (in terms of arrays in a bundled state or the array intervals), the inclusion of polishing particles, use of metal, and the like.

Potential Utility in Industry

The small-diameter resin twisted brush of this invention, which does not use metal in the stem section, will be free of any discomfort due to a galvanic current between the saliva and metal, and raises no concern about metal-induced allergy, when used as an oral cleaning device, as an interdental brush for control of the plaque between teeth which can cause periodontal disease; and while structurally it is the same as a conventional twisted tooth brush, the stem is provided with enough suppleness, maintains straightenability (shape recoverability) immediately after use in a bent or deformed situation, and suffers only rarely stress fatigue due to repetitious use; thereby there is less chance of breakage, giving rise to a highly durable interdental brush. These features may be taken advantage of and suitably used as a tip brush for connection to the motion shaft of an electrical interdental cleaning device that generate a sliding motion, a rotating motion, or rotary-sliding motion as in Japanese Patent Applications 2000-380686 and 2001-230207 . Furthermore, this metal-free twisted brush permits a cleaning, polishing, or coating operation of a complicated shape site which has been difficult for a conventional metal twisted brush, by making it possible not only to take advantage of the characteristics of the resin stem section, but also to reach a further deeper penetration depth than a conventional metal twist brush, which permits cleaning and polishing operations for parts such as machine parts with a complicated shape that have been impossible to clean, leaving no uncleaned corners.

Unlike a metal twisted brush with the hard sensation appearance of metal, the resin soft sensation reduces fear and thus provides comfort when used in front of the eye such as a for a mascara brush used for an eyelash cosmetic.

What is claimed is:

1. A small-diameter resin twisted brush comprising:

a plurality of resin filaments having resilience, straightenability, and suppleness;

at least two resilient stem resin filament rods;

said plurality of resin filaments being clamped between said at least two resilient stem resin filament rods;

said at least two resilient resin stem rods being twisted about one another, thereby forming said brush with helical bristles formed by said plurality of resin filaments extending radially from said at least two twisted resilient stem resin filament rods, whereby said small-diameter resin twisted brush is capable of adapting to three-dimensional deformed conditions and of recovering an initial shape; and at least one thermally fusible resin filament rod parallel to said at least two resilient stem resin filament rods, whereby said at least one thermally fusible resin filament rod is fused during manufacture of said small-diameter resin twisted brush to firmly hold said plurality of resin filaments between said at least two twisted resilient stem resin filament rods, and to prevent said at least two twisted resilient stem resin filament rods from detwisting.

2. A small-diameter resin twisted brush as claimed in claim 1, wherein said at least two resilient stem resin filament rods are coated with a thermally fusible resin material, whereby said thermally fusible resin material is fused during manufacture of said small-diameter resin twisted brush to firmly hold said plurality of resin filaments between said at least two twisted resilient stem resin filament rods, and to prevent said at least two twisted resilient stem resin filaments from detwisting.

3. A small-diameter resin twisted brush as claimed in claim 1, wherein said at least two resilient stem resin filament rods are color-coded with a pigmented resin to indicate the size of said helical bristles.

4. A small-diameter resin twisted brush as claimed in claim 1, wherein ends of said at least two resilient stem resin filament rods adjacent to said helical bristles are smoothed to remove sharp edges.

5. A small-diameter resin twisted brush as claimed in claim 1, wherein the radially-extending resin filaments are positioned at fixed intervals flanked by sections lacking resin filaments.

6. A small-diameter resin twisted brush as claimed in claim 5, wherein the stem resin filament rods are cut at the section lacking resin filaments and the ends of said at least two resilient stem resin filament rods adjacent to said helical bristles are smoothed to remove sharp edges.

* * * * *